US005286200A

United States Patent [19]

Wurz et al.

[11] Patent Number: 5,286,200

[45] Date of Patent: Feb. 15, 1994

[54] ROTARY KILN

[75] Inventors: Dieter Wurz, Baden-Baden; Arvid Christmann, Pulheim; Gebhard Schetter, Krefeld; Wilfried Schings, Oberhausen; Dietmar Schneider, Dusseldorf; Rüdiger Trumpf, Essen, all of Fed. Rep. of Germany

[73] Assignee: Deutsche Babcock Anlagen GmbH, Oberhausen, Fed. Rep. of Germany

[21] Appl. No.: 978,401

[22] Filed: Nov. 18, 1992

[30] Foreign Application Priority Data

Jul. 24, 1992 [DE] Fed. Rep. of Germany ..... 4224571

[51] Int. Cl.[5] ..... F27B 7/36

[52] U.S. Cl. ..... 432/105; 432/111; 432/113; 432/117; 110/246

[58] Field of Search ..... 432/103, 105, 113, 117, 432/111; 110/246, 244

[56] References Cited

U.S. PATENT DOCUMENTS

| | | | |
|---|---|---|---|
| 4,288,215 | 9/1981 | Grim | 432/103 |
| 4,541,346 | 9/1985 | Culliford | 110/246 |
| 4,859,177 | 8/1989 | Kreisberg et al. | 432/105 X |
| 4,934,931 | 6/1990 | Angelo, II | 432/113 X |
| 5,005,493 | 4/1991 | Gitman | 110/246 |
| 5,199,357 | 4/1993 | Garcia-Mallol | 110/244 X |

*Primary Examiner*—William E. Tapolcal
*Attorney, Agent, or Firm*—Rogers & Killeen

[57] ABSTRACT

A rotary kiln with primary air feed at the end wall of the rotary kiln is distinguished by the feature that at least two primary air nozzles are oriented relative to each other and to the fuel bed so that two oppositely directed vortices are generated within the rotary kiln, the axes of rotation of said vortices extending substantially parallel to the axis of the rotary kiln and said vortices rotating about said axes of rotation so as to promote the thermal convection-induced motion of the combustion gases.

21 Claims, 2 Drawing Sheets

ROTARY KILN

Hazardous waste is preferentially incinerated in rotary kilns. The combustion gases from the rotary kiln are introduced into a post combustion chamber where they can burn out under temperature and residence time conditions in accordance with statutory regulations.

FIGS. 1 and 2, which represent a schematic longitudinal section and a cross-section II—II of FIG. 1, illustrate an example of such a prior art incineration plant.

Solid and pasty waste is charged through a feeding chute 2 or in bundles at the fixed end wall 4 of the rotary kiln 1 across the inlet section 3. Residuary liquids are also fed via this end wall 4. Furthermore, residuary liquids of higher calorific value and contaminated wastewater are injected into a post combustion chamber 6. Here, reliable atomization into very small droplets is of major importance to avoid using up substantial amounts of the residence time in the post combustion chamber for the process of droplet evaporation.

The quantity of combustion air and its way of feeding are of major importance to the process of combustion in the rotary kiln 1. Previously, the combustion air has been fed through the feeding chute 2 for the solid fuel or through a nozzle system into the rotary kiln 8 of the rotary kiln 1. The velocity of the primary air introduced via the feeding chute 2 is relatively low so that only little energy is available for generating turbulence. Furthermore, the momentum of flow of the two kinds of primary air introduction comprises a strong component in the direction of the axis A of the rotary kiln so that portions of the flue gases may pass relatively quickly through the rotary kiln even if a low-momentum return flow area is produced in the portion of the rotary kiln near the end wall. This results in an insufficient burnout on the gaseous-phase side in the rotary kiln 8 requiring intensive post combustion in the post combustion chamber 6. Moreover, with this type of primary air supply the air flows down on the bed of burning material 10 in the direction of the arrow F. Thereby the flue gases in the front area of the rotary kiln are forced to ascend sideways within the rotary kiln. This results in the formation of two indistinctive and quickly disintegrating, oppositely directed vortices 12, 14. The natural behaviour of the flames which is accompanied by the development of thermal convection which also generates turbulences and ascends in the central plane of the rotary kiln in the direction of the arrow T is counteracted by the above phenomenon, for though thermal convection will also produce a pair of vortices 13, 15 these will rotate in opposition to the pair of vortices 12, 14 produced by the primary air supply.

It is well known that temperature, residence time and turbulence are of paramount importance in respect of a desirable maximum burnout of the residues. Considering the processes from a superficial standpoint without sufficient insight in the essential physical and chemical process flows one might come to the conclusion that increased turbulence would be an impediment to maintaining a required residence time; this is due to the fact that in the case of an ideal agitated vessel with strong turbulence, portions of the feed will have passed through the reactor already after a short random residence time.

The discharge of larger particles from rotary kiln and post combustion chamber is also very important with a view to achieving complete burnout. Since large particles burn out relatively slowly, their discharge from the rotary kiln should be prevented as far as possible. When a primary air jet of increased flow rate is directed to the front portion of the bed of burning material, large solid particles may be whirled up increasingly and discharged from the rotary kiln. This should also be prevented.

The invention is based on the objective of ensuring maximum burnout of the residues both in the gaseous and in the solid phase.

The specified objective is achieved by claim 1.

Thus, the present invention proposes a novel way of feeding primary air. Whereas previously the feeding of primary air counteracted the natural convection within the rotary kiln, the novel way of feeding primary air according to the present invention promotes the natural convection, i.e. the convection induced by thermal up-currents.

This is due to the realization that turbulence has indeed a highly beneficial influence on the process of combustion but that above all one should aim at a cross transfer in respect of the axial position in rotary kiln and post combustion chamber, whereas an intensive rough-scale turbulence in longitudinal direction will have detrimental results. Hence, speaking summarily of the positive effect of turbulence this always implies that a rough-scale turbulence across the axis of rotary kiln and post combustion chamber is assumed, while the mean-scale and fine-scale turbulence, which necessarily also has strong coaxial components, has no preferred direction.

When a rotary kiln system according to the present invention is employed, the processes which normally occur only in the post combustion chamber are largely completed already within the rotary kiln so that the post combustion chamber merely functions as a security reaction zone. This permits operation with reduced oxygen content while the mixing rate is intensified resulting in an improved temperature/residence time characteristic. It is thereby possible to reduce the use of higher-grade fuels to a considerable extent. The concept of the present invention may be summarized as follows:

> "a rotary kiln system with dual-vortex combustion air control for integrated post combustion of gaseous harmful materials".

Since the motive mechanism which is involved due to the thermal convection induced by the flames will only decrease towards the end portion of the rotary kiln remote from the end wall, a vortex pair which is generated near the end wall of the rotary kiln by oppositely directed tangential introduction of primary air and which rotates in the same sense as the thermal convection-induced turbulent flow will have a far stronger effect irrespective of wall friction than a vortex pair which rotates in opposition to the thermal convection-induced vortex pair or than a single vortex.

The generation of the vortex pair also causes small-scale strong remixing of hot combustion gases in the end wall area, whereby the ignition of the waste material to be incinerated is promoted.

The primary air supply of the present invention substantially improves mixing within the rotary kiln, which is mainly due to a lateral effect. This is also of major importance because with increasing resource recovery the calorific value of solid and liquid wastes will decrease more and more. It is therefore of major interest to enhance burnout with reduced oxygen supply. This can be achieved with the present invention.

If too much air as an oxygen carrier and momentum reservoir for mixing processes is introduced, the temperature of the combustion products will inevitably drop actually necessitating the use of considerable supplementary fuel to satisfy the conditions of temperature/residence time. This results in the paradoxical concept that on the one hand, in compliance with the required resource recovery, components of higher calorific value (for example solvents) are recovered from the waste at considerable costs and with a limited degree of purity while on the other hand valuable raw materials (fuel oil, natural gas) have to be used so as to achieve the required temperatures in the post combustion chamber.

With the present invention this is avoided as far as possible.

Another aspect which has been found in the course of extensive experimental tests is the following one:

When primary air is supplied through the solids feeder (feeding chute) there is only a weak velocity gradient in the gaseous phase adjacent the fuel bed already after half the length of the rotary kiln. Hence, the oxygen supply in the outlet-side area of the fuel bed within the rotary kiln is affected. In contrast thereto, the dual-vortex configuration of the present invention strongly promotes the momentum and mass transfer and consequently the oxygen supply as well as the coarse, medium and fine-scale mixing of the reactants even in an area beyond half the length of the rotary kiln. An accelerated discharge of the combustion products from the combustion zone also has a beneficial influence on the burnout at the top of the fuel bed.

Below, the invention will be explained in detail by way of an embodiment thereof with reference to schematic drawings, in which.

Figure 1:
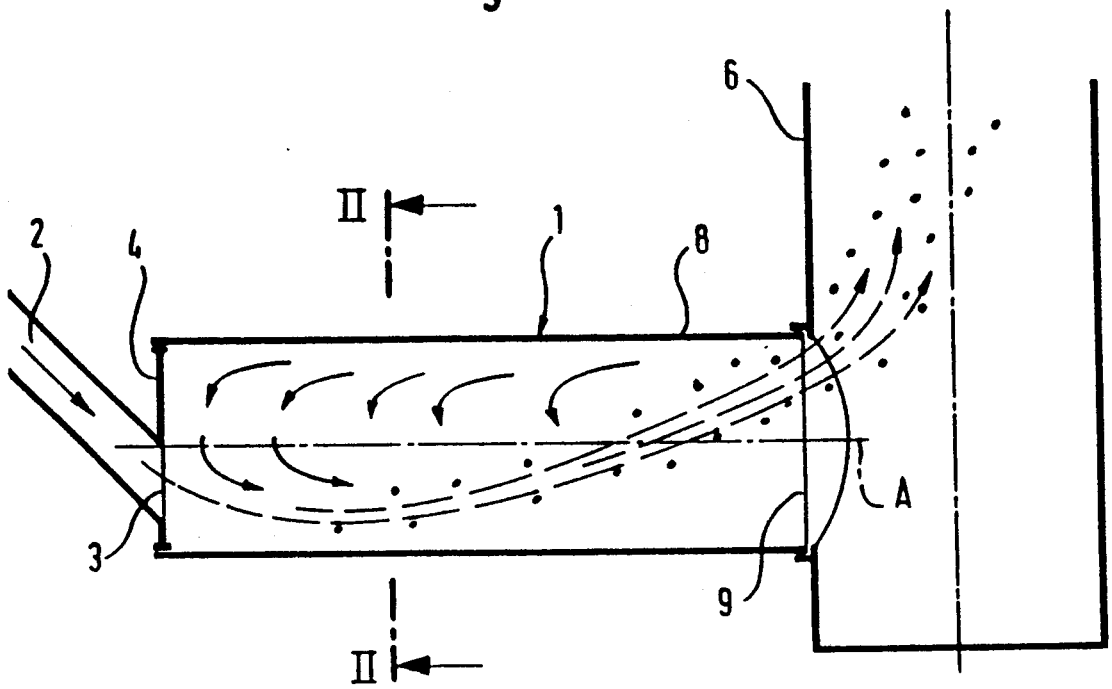
Fig. 1 (PRIOR ART)
Figure 2:
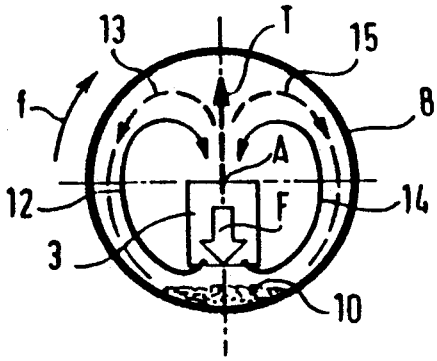
Fig. 2 (PRIOR ART)
Figure 3:
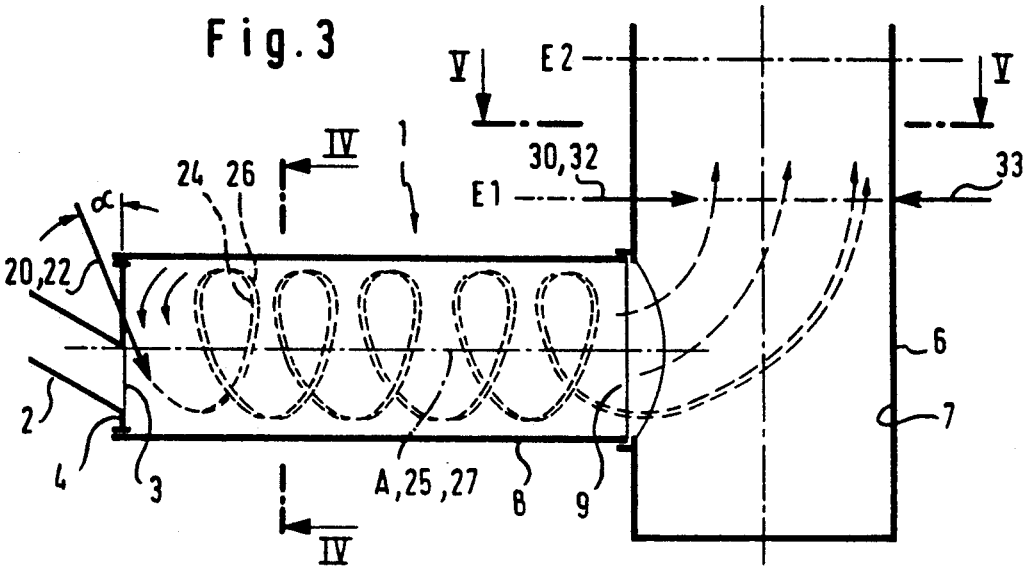
FIG. 3 is a schematic longitudinal section through a rotary kiln system of the present invention.
Figure 4:
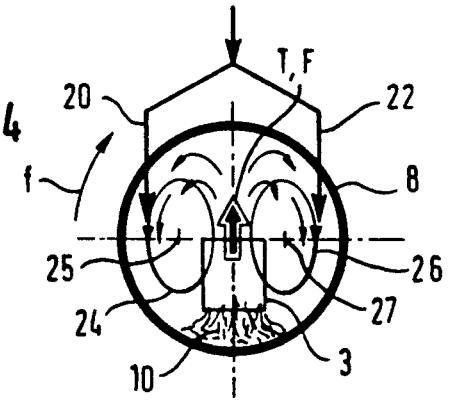
FIG. 4 is a cross-section along the line IV—IV of FIG. 3.
Figure 5:
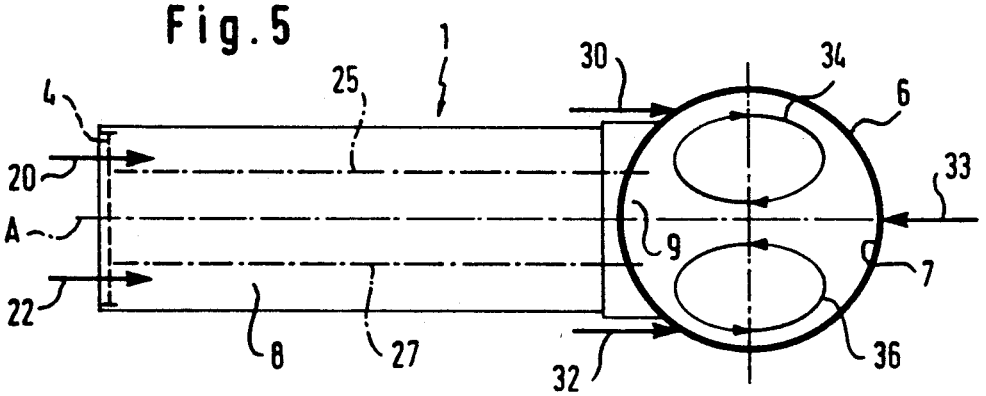
FIG. 5 is a cross-section along the line V—V of FIG. 3.

In the FIGS. 3 to 5, identical parts are identified with the same reference symbols used in FIGS. 1 and 2.

FIGS. 3 and 4 illustrate the field of flow resulting from a view into the clockwise rotating rotary kiln 8 through an end wall 4 which is assumed to be transparent and does not rotate with the rotary kiln 8. At least two and at most eight primary air nozzles 20, 22 extend through the top portion of the end wall 4 at an angle $\alpha$. As viewed from the end wall 4 (FIG. 4) the primary air is injected substantially tangentially to a circle about the axis (A) of the rotary kiln through the primary air nozzles 20, 22 (i.e. not via the feeding chute 2) so that two oppositely directed vortices 24, 26 are generated with their axes of rotation 25, 27 and their directions of rotation parallel to the axis (A) of the rotary kiln and resulting in a central ascending flow in the same direction as the thermal convection-induced motion of the combustion gases (double arrow T,F). On its way to the fuel bed 10 the primary air is heated by admixture of recirculated combustion gases (FIG. 4) whereby the fire is fanned from either side of the fuel bed 10.

By varying the angle of inclination of the primary air nozzles 20, 22 it is possible to match the steepness of slope of the vortex spiral with the requirements of the respective fuel bed 10 such as the local oxygen demand. For example, the inclination $\alpha$ of the air nozzles (20, 22) may vary between 45° and 80°.

To enable a variation of the admixture of recirculating flue gases into the primary air jet during operation it is possible to equip each of the two to eight primary air nozzles 20, 22 with an adjustable swirl generating means (variable swirl directing grid). While an inherently non-swirling primary air jet will remain comparatively well-bundled and will penetrate the fuel bed 10 with a considerable momentum which may be accompanied by an increase in flying sparks, a primary air jet with increasing inherent swirl will become weaker by the admixture of combustion gases. The primary air nozzles (20,22) may also be adapted to be rotatable about their longitudinal axes in the end wall (4) of the rotary kiln (1) so as to permit a variation of the turning moment of the primary air jet relative to the axis (A) of the rotary kiln.

This permits adaptation to the requirements of the fuel bed 10 with little effort.

Mixed operation may be advantageous under certain conditions, where a given percentage of primary air is fed as before via the solid fuel feeder (feeding chute 2 as shown in FIG. 1) into the rotary kiln 1. This applies particularly to preventing the feeding of stirred up particles into the feeding chute 2.

Furthermore, making use of a momentum introduced by the end wall burner (not illustrated) for producing the "dual vortices" 24, 26 may be advantageous under certain boundary conditions. For example, the end wall burner may be arranged and directed to controllably influence the formation of vortices so as to permit mixed operation.

Since the "dual vortex system" of the invention as described above still exhibits a relevant angular momentum at the rotary kiln outlet 9 in the end of the rotary kiln remote from the end wall it would be reasonable to make use of the quantity of motion existing in said vortex system for mixing processes in the post combustion chamber 6. Consequently, an improvement of the basic concept provides that the burners and mixed-air nozzles 30, 32, 33 disposed at the transition between the rotary kiln 1 and the post combustion chamber 6 or in the post combustion chamber 6, respectively, are arranged such that the already existing mixing tendency is enhanced by the dual vortex 24, 26 exiting from the rotary kiln 1 so that oppositely directed vortices 34, 36 will also exist in the post combustion chamber 6. As regards the arrangement of burners and mixed-air nozzles 30, 32, 33 in the post combustion chamber 6 it is of paramount importance that the individual sources of momentum should not be too weak. Therefore the number of burners or mixed-air nozzles must not be too high. A preferred configuration will probably be an arrangement comprising at least three burners according to FIG. 5 or, reversely, comprising only one central burner 33 on the rotary kiln side and two burners 30, 33 on the side (wall 7) of the post combustion chamber 6 remote from the rotary kiln.

Appropriately, the configuration comprising three nozzles or burners 30, 32, 33 would be arranged in a common horizontal plane E1 (FIG. 3).

To supplement the vortex producing effect it may also prove advantageous to provide within the post combustion chamber 6 a plurality of such sets of, for example, three burners or mixed-air nozzles, each set being distributed in parallel planes along the height of the post combustion chamber 6, as indicated by a second plane E2 in FIG. 3.

We claim:

1. A rotary kiln with primary air feed at the end wall (4) thereof comprising:

at least two primary air nozzles (20, 22) that extend through spaced-apart portions of the end wall (4) and are directed into a rotary portion (8) of the kiln downwardly toward a fuel bed (10) thereof for generating two oppositely directed vortices (24, 26) within the rotary portion (8), the axes of rotation (25, 27) of said vortices extending substantially parallel to the axis (A) of the rotary portion (8), so that said vortices generate a central ascending flow above the fuel bed (10) and thereby promoting the thermal convection-induced motion (arrow T) of combustion gases.

2. The rotary kiln as claimed in claim 1 further comprising:

a post combustion chamber (6); and plural ones of either auxiliary burners or mixing air nozzles (30, 32) that project tangentially from opposing portions of said post combustion chamber for enhancing said two oppositely directed vortices (24, 26) exiting from the rotary kiln (1).

3. The rotary kiln as claimed in claim 1, wherein not more than eight primary air nozzles (20, 22) extend at an angle ($\alpha$) through the end wall (4) of the rotary kiln (1).

4. The rotary kiln as claimed in claim 3, wherein said primary air nozzles (20, 22) are adapted to be turned on and off separately.

5. The rotary kiln as claimed in claim 1, wherein the primary air nozzles (20, 22) are disposed on a circular arc or a similar geometrical locus in the upper half of the end wall (4) of the rotary kiln (1).

6. The rotary kiln as claimed in claim 1, wherein the angle ($\alpha$) of the primary air nozzles (20, 22) relative to the end wall of the rotary kiln is variable within a range of from 45° to 80° for matching with the demands of the fire.

7. The rotary kiln as claimed in claim 1, wherein the primary air nozzles (20, 22) are adapted to be rotatable about their longitudinal axes in the end wall (4) of the rotary kiln (1) so as to permit a variation of the turning moment of the primary air jet relative to the axis (A) of the rotary kiln.

8. The rotary kiln as claimed in claim 1, wherein the primary air nozzles (20, 22) are directed in opposite directions tangentially to an arc about the axis (A) of the rotary portion (8).

9. The rotary kiln as claimed in claim 1, wherein an adjustable, variable-twist guide ring is fitted into each primary air nozzle (20, 22) for adapting the admixture of recirculated combustion gases.

10. The rotary kiln as claimed in claim 1, wherein primary air is additionally fed through a feeding chute (2) used for fuel feeding so as to permit mixed operation.

11. The rotary kiln as claimed in claim 1, wherein an end wall burner is arranged and directed for controlledly influencing the formation of vortices so as to permit mixed operation.

12. The rotary kiln as claimed in claim 1 further comprising a post combustion chamber (6); and at least one burner and/or one mixed-air nozzle (33) that projects radially from the wall (7) of the post combustion chamber (6) which is opposite the exit (9) from the rotary kiln for enhancing said two oppositely directed vortices (24, 26) exiting from the rotary kiln (1).

13. The rotary kiln as claimed in claim 1 further comprising a post combustion chamber (6); and at least one pair of either burners or mixed-air nozzles (30, 32) disposed on opposing portions of the circumference of the post combustion chamber (6) and directed in opposing directions so as to enhance the symmetrical dual-vortex system with oppositely directed vortices (34, 36) in the post combustion chamber (6).

14. The rotary kiln as claimed in claim 13 wherein the burners or mixed-air nozzles (30, 32) are adapted to be turned on and off separately.

15. The rotary kiln as claimed in claim 13, wherein the burners and/or mixed-air nozzles (30, 32) are arranged in a horizontal plane (E1).

16. The rotary kiln as claimed in claim 13, comprising a plurality of said pair of burners and/or mixed-air nozzles that are arranged in parallel planes (E1, E2) distributed along the height of the post combustion chamber (6).

17. The rotary kiln of claim 3 wherein said angle $\alpha$ is from 45° to 80°.

18. A rotary kiln comprising:

plural nozzle means for generating two oppositely directed vortices generating a central ascending flow in the same direction as the thermal convection-induced motion of combustion gases in a combustion chamber of said kiln;

said combustion chamber comprising a tubular portion rotatable about a longitudinal axis, said tubular portion having a burning area therein not being rotatable therewith, and an end portion at one end of said tubular portion not being rotatable with said tubular portion; and said plural nozzle means comprising at least two nozzles extending through said end portion in generally parallel directions, said nozzle means extending through said end portion on opposite sides of a line extending from said burning area through said longitudinal axis so that said two vortices each have a portion coincident with and moving in the same direction as said line.

19. The rotary kiln of claim 18 further comprising means for varying the number of turns made by said two vortices in said combustion chamber.

20. The rotary kiln of claim 18 further comprising a post combustion chamber connected to an exit from said combustion chamber, said post combustion chamber having further nozzle means for enhancing said two vortices after they exit said combustion chamber.

21. A rotary kiln comprising:

plural nozzle means for generating two oppositely directed vortices generating a central ascending flow in the same direction as the thermal convection-induced motion of combustion gases in a combustion chamber of said kiln; and a post combustion chamber connected to an exit from said combustion chamber, said post combustion chamber having further nozzle means for enhancing said two vortices after they exit said combustion chamber.

* * * * *